US010968866B2

(12) United States Patent
Lejon

(10) Patent No.: US 10,968,866 B2
(45) Date of Patent: Apr. 6, 2021

(54) GAS ENGINE, METHOD FOR OPERATING A GAS ENGINE AND GENERATOR SET

(71) Applicant: Scania CV AB, Södertälje (SE)

(72) Inventor: Svante Lejon, Huddinge (SE)

(73) Assignee: SCANIA CV AB

( * ) Notice: Subject to any disclaimer, the term of this patent is extended or adjusted under 35 U.S.C. 154(b) by 0 days.

(21) Appl. No.: 16/604,218

(22) PCT Filed: Apr. 20, 2018

(86) PCT No.: PCT/SE2018/050399
§ 371 (c)(1),
(2) Date: Oct. 10, 2019

(87) PCT Pub. No.: WO2018/194510
PCT Pub. Date: Oct. 25, 2018

(65) Prior Publication Data

US 2020/0166006 A1 May 28, 2020

(30) Foreign Application Priority Data

Apr. 21, 2017 (SE) ..... 1750474-7

(51) Int. Cl.
*F02M 21/02* (2006.01)
*F02B 19/12* (2006.01)
(Continued)

(52) U.S. Cl.
CPC ..... *F02M 21/0239* (2013.01); *F02B 19/12* (2013.01); *F02B 29/0406* (2013.01); *F02B 37/001* (2013.01); *F02B 63/042* (2013.01)

(58) Field of Classification Search
CPC . F02M 21/0239; F02B 19/12; F02B 19/1023; F02B 19/1052; F02B 37/001; F02B 37/007; F02B 43/02; F02B 63/042
See application file for complete search history.

(56) References Cited

U.S. PATENT DOCUMENTS 5,899,070 A 5/1999 Droessler et al. ..... 60/612
2009/0071439 A1 3/2009 Shiraishi et al. ..... 123/403
(Continued)

FOREIGN PATENT DOCUMENTS

CN 102425488 A 4/2012
CN 102803676 A 11/2012
(Continued)

OTHER PUBLICATIONS

Office Action dated Nov. 29, 2017 in corresponding Swedish Patent Application No. 1750474-7.
(Continued)

*Primary Examiner* — Sizo B Vilakazi
*Assistant Examiner* — Anthony L Bacon
(74) *Attorney, Agent, or Firm* — Ostrolenk Faber LLP

(57) ABSTRACT

An internal combustion gas engine (2) is disclosed. It includes a cylinder arrangement (4) and a first compressor (6) for compressing a gaseous fuel and air mixture. The at least one cylinder arrangement (4) forms a combustion chamber (8) and includes an intake arrangement (10) for intake of charge gas, a sparkplug (12), and a pre-chamber (14). The engine (2) comprises a second compressor (16) for compressing a gaseous medium, and a pressure reducer (18). An outlet (20) of the first compressor (6) is arranged in parallel with an outlet (22) of the second compressor (16). The outlet (20) of the first compressor (6) is connected to the pre-chamber (14). The outlet (20) of the first compressor (6) and the outlet (22) of the second compressor (16) are connected to the pressure reducer (18). An outlet (24) of the pressure reducer (18) is connected to the intake arrangement (10).

20 Claims, 4 Drawing Sheets

(51) Int. Cl.

| | |
|---|---|
| ***F02D 29/04*** | (2006.01) |
| ***F02B 37/00*** | (2006.01) |
| ***F02B 63/04*** | (2006.01) |
| ***F02B 29/04*** | (2006.01) |

(56) References Cited

U.S. PATENT DOCUMENTS

| | | | | |
|---|---|---|---|---|
| 2016/0017845 | A1* | 1/2016 | Huang | F02B 39/04 290/1 A |
| 2016/0040609 | A1* | 2/2016 | Flohr | F02D 19/0613 123/526 |
| 2016/0053724 | A1* | 2/2016 | Flohr | F02D 41/0027 123/528 |
| 2016/0169085 | A1 | 6/2016 | Wimmer et al. | |
| 2016/0215683 | A1* | 7/2016 | Graus | F02B 19/10 |
| 2017/0051634 | A1* | 2/2017 | Sealy | F02M 21/06 |
| 2018/0003136 | A1* | 1/2018 | Coldren | F02M 59/464 |

FOREIGN PATENT DOCUMENTS

| | | | | |
|---|---|---|---|---|
| DE | 198 12 796 | A1 | 8/1999 | |
| DE | 10 2016 112537 | A1 | 1/2018 | |
| EP | 2 067 954 | A1 | 6/2009 | |
| EP | 2362 077 | A2 | 8/2011 | |
| EP | 2 977 595 | A1 | 1/2016 | |
| JP | H03-275968 | A | 12/1991 | |
| JP | H05-302513 | A | 11/1993 | |
| JP | 2014-159792 | A | 9/2014 | |
| JP | 2017-002728 | A | 1/2017 | |
| NO | 20171112 | A1 * | 1/2018 | F02B 19/10 |

OTHER PUBLICATIONS

International Search Report dated Jun. 26, 2018 in corresponding PCT International Application No. PCT/SE2018/050399.

Written Opinion dated Jun. 26, 2018 in corresponding PCT International Application No. PCT/SE2018/050399.

L.A. Gussak et al., "High Chemical Activity of Incomplete Combustion Products and a Method of Pre-chamber Torch Ignition for Avalanche Activation of Combustion in Internal Combustion Engines," SAE International paper No. 750890, 1975, 25 pages.

European Search Report, dated Dec. 10, 2020, issued in corresponding European Patent Application No. 18787173.6. Total 5 pages.

Chinese Office Action, dated Dec. 8, 2020, issued in corresponding Chinese Patent Application No. 201880025996.8 English translation. Total 15 pages.

* cited by examiner

GAS ENGINE, METHOD FOR OPERATING A GAS ENGINE AND GENERATOR SET

CROSS-REFERENCE TO RELATED APPLICATIONS

The present application is a 35 U.S.C. §§ 371 national phase conversion of PCT/SE2018/050399, filed Apr. 20, 2018, the contents of which are incorporated herein by reference, which claims priority of Swedish Application No. 1750474-7 filed Apr. 21, 2017, the contents of which are incorporated by reference herein. The PCT International Application was published in the English language.

TECHNICAL FIELD

The invention relates to an internal combustion gas engine. The invention further relates to a generator set comprising an internal combustion and an electric generator. The invention further relates to a method for operating an internal combustion gas engine.

BACKGROUND

A gas engine is an internal combustion engine which runs on a gaseous fuel, such as biogas, natural gas, liquefied petroleum gas (LPG), or other gas. One way to achieve a gas engine with low $NO_X$ emissions is to run the gas engine on a lean fuel mixture, e.g. at $\lambda \approx 2$. Such a lean mixture cannot be ignited directly by a sparkplug of the engine. Instead a pre-chamber arranged at a sparkplug is filled with a richer fuel mixture, which may be ignited by the sparkplug. This may in turn ignite the lean fuel mixture in a combustion chamber of the engine. Accordingly, in a gas engine the rich fuel mixture must be conducted to the pre-chamber, while the lean fuel mixture is conducted to the combustion chamber in order to achieve low $NO_X$ emissions from the engine.

DE19812796 discloses a gas engine which is supplied with a lean mixture gas feed via an exhaust gas driven turbocharger. A drive cylinder of a piston compressor is connected between an inlet port and outlet port of the turbocharger. The piston is brought to reciprocate under the control of a switch-valve unit. The compressor compresses low pressure rich fuel mixture for feeding a pre-chamber of a combustion chamber of the engine, or for holding in a buffer receiver. The lean mixture gas pressure from the turbocharger is reduced at an intake of the gas engine due to the lean gas mixture being utilized for driving the compressor.

JPH03275968 discloses a spark-ignition gas engine. Combustion gas at low pressure is separated into a main flow leading to a gas mixer and a turbocharger, and an auxiliary flow leading to a gas compressor. The gas mixer forms a combustion gas of lean mixture needed for low NOx combustion. The gas compressor is driven by the rotary shaft of the gas engine and increases the pressure of the auxiliary flow for supply to a pre-chamber, which requires a gas supply pressure higher than turbocharged pressure. The pressure is adjusted to a fixed differential pressure by a pressure governor before being led into the pre-chamber through a gas valve. Driving the gas compressor reduces useful power at the rotary shaft of the gas engine.

SUMMARY OF THE INVENTION

It would be advantageous to achieve an internal combustion gas engine overcoming, or at least alleviating, at least some of the above mentioned drawbacks. In particular, it would be desirable to enable provision of a rich gaseous fuel mixture to a pre-chamber of a gas engine without reducing available engine power. To better address one or more of these concerns, an internal combustion gas engine and a method for operating an internal combustion gas engine have features defined herein.

According to an aspect there is provided an internal combustion gas engine comprising at least one cylinder arrangement and a first compressor configured for compressing a gaseous fuel and air mixture. The at least one cylinder arrangement forms a combustion chamber and comprises an intake arrangement for intake of charge gas into the combustion chamber, a sparkplug, and a pre-chamber arranged in connection with the combustion chamber and the sparkplug. The internal combustion gas engine further comprises a second compressor configured for compressing a gaseous medium, and a pressure reducer. An outlet of the first compressor is arranged in parallel with an outlet of the second compressor. The outlet of the first compressor is connected to the pre-chamber. The outlet of the first compressor and the outlet of the second compressor are connected to the pressure reducer. An outlet of the pressure reducer is connected to the intake arrangement.

Since the outlet of the first compressor is connected to the pre-chamber, a first gaseous fuel mixture is conducted to the pre-chamber from the first compressor during use of the internal gas combustion engine. Since the outlet of the first compressor and the outlet of the second compressor are arranged in parallel and connected to the pressure reducer, and since an outlet of the pressure reducer is connected to the intake arrangement, a second gaseous fuel mixture is conducted to the intake arrangement during use of the internal combustion gas engine. Accordingly, during use of the internal combustion gas engine, the first gaseous fuel mixture, which suitably is a richer gaseous fuel mixture than the second gaseous fuel mixture is conducted to the pre-chamber for ignition thereof by the sparkplug, and the second gaseous fuel mixture is a leaner gaseous fuel mixture than the first gaseous fuel mixture, which lean gaseous fuel mixture is conducted to the intake arrangement of the internal combustion gas engine for low $NO_X$ combustion in the combustion chamber. This is achieved without requiring a separate compressor, which consumes energy from the internal combustion gas engine, for compressing a separate rich gaseous fuel mixture to the pre-chamber. Instead two compressors, the outlets of which are arranged in parallel, are utilized for blending a lean gaseous fuel mixture, and a portion of the rich gaseous fuel mixture from the first compressor is directed to the pre-chamber. The lean gaseous fuel mixture comprises a portion of the rich gaseous fuel mixture and the gaseous medium from the second compressor. As a result, the internal combustion gas engine provides for a rich gaseous fuel mixture and a lean gaseous fuel mixture utilising two compressors, the work performed therein being utilised in the internal combustion gas engine. Thus, the above mentioned object is achieved.

It has been realized by the inventor that by utilizing a first and a second compressor, the first compressor compressing a rich gaseous fuel mixture suitable for provision to the pre-chamber, the second compressor compressing a gaseous medium, and blending a portion of the rich gaseous fuel mixture with the gaseous medium to provide a lean gaseous fuel mixture, the two gaseous fuel mixtures required for low $NO_X$ combustion in an internal combustion gas engine may be provided. This, without requiring a dedicated compressor for feeding the pre-chamber with a rich gaseous fuel mixture.

The internal combustion gas engine which runs on a gaseous fuel, such as e.g. biogas, natural gas, liquefied petroleum gas (LPG), or other gas. The internal combustion gas engine may be either a four-stroke or a two-stroke internal combustion engine. The sparkplug is arranged such that is may ignite a gaseous fuel mixture in the pre-chamber. During operation of the internal combustion gas engine, air and gaseous fuel are provided to an inlet of the first compressor for being compressed in the first compressor and forming a gaseous fuel mixture. The gaseous medium compressed in the second compressor may be either air, or a leaner gaseous fuel mixture than the gaseous fuel mixture compressed in the first compressor. The pressure reducer may comprise e.g. an expander and/or a valve. The pressure reducer is configured to reduce a pressure of the charge gas, i.e. the gaseous fuel mixture reaching the intake arrangement. The intake arrangement may comprise at least one intake valve arranged to seal against an intake valve seat. Depending on the composition of the rich gaseous fuel mixture in the pre-chamber, either in pre-chamber combustion, or avalanche activated combustion may be may be utilized for igniting the lean gaseous fuel mixture inside the combustion chamber.

Herein, unless otherwise stated, one component being connected with a different component means that the components are fluidly connected, i.e. a fluid may be conducted from one component to a different component via one or more delimited spaces forming one or more conduits for the fluid.

According to a further aspect there is provided a method for operating an internal combustion gas engine. The internal combustion gas engine comprising at least one cylinder arrangement, a first compressor configured for compressing a gaseous fuel and air mixture, a second compressor configured for compressing a gaseous medium, and a pressure reducer. The at least one cylinder arrangement forms a combustion chamber and comprises an intake arrangement for intake of charge gas into the combustion chamber, a sparkplug, and a pre-chamber arranged in connection with the combustion chamber and the sparkplug.

The method comprises steps of:

- conducting a rich gaseous fuel mixture from an outlet of the first compressor to the pre-chamber,
- mixing a lean gaseous fuel mixture by blending the rich gaseous fuel mixture from the outlet of the first compressor with the gaseous medium from an outlet of the second compressor,
- reducing a pressure of the lean gaseous fuel mixture in the pressure reducer, and
- conducting the lean gaseous fuel mixture as a charge gas to the intake arrangement.

As discussed above, in this manner a rich gaseous fuel mixture is provided to the pre-chamber for ignition thereof with the sparkplug, while a lean gaseous fuel mixture is provided to the intake arrangement and the combustion chamber as a charge gas. This is achieved without requiring a separate compressor, which consumes energy from the internal combustion gas engine for compressing a separate rich gaseous fuel mixture to the pre-chamber.

According to a further aspect there is provided a generator set comprising an internal combustion engine and an electric generator, wherein a crankshaft of the internal combustion engine is connected to a shaft of the electric generator. The internal combustion engine is an internal combustion gas engine according to any one of aspects and/or embodiments discussed herein.

The generator set utilises the internal combustion gas engine for producing electrical energy in the electric generator. Thus, the advantages of the internal combustion gas engine discussed herein are utilized in the generator set.

According to embodiments, the at least one cylinder arrangement comprises an exhaust arrangement for outflow of exhaust gas from the combustion chamber. The first compressor may comprise a first turbocharger and the second compressor may comprise a second turbocharger. The exhaust arrangement may be connected to the first and second turbochargers for driving the first and second turbochargers. In this manner, energy from the exhaust gases of the internal combustion gas engine may be utilized for compressing the gaseous fuel and air mixture, as well as the gaseous medium.

According to embodiments, wherein the pressure reducer comprises an expander, an output shaft of the expander may be connected to a crankshaft of the internal combustion gas engine. In this manner, a pressure reduction of the charge gas may provide additional energy to the crankshaft of the internal combustion gas engine for increasing the available power output from the internal combustion gas engine.

According to alternative embodiments, an output shaft of the expander may be connected to an electric generator. In this manner, a pressure reduction of the charge gas may be utilized for generating electrical energy in the electric generator. The electric generator may for instance be an electric generator of a generator set, which electric generator may also be driven by the internal combustion gas engine.

According to embodiments, the internal combustion gas engine may comprise a third compressor, wherein the third compressor may be arranged in series with the first and second compressors upstream of the pressure reducer. In this manner, a pressure of the lean gaseous fuel mixture may be further increased over that achieved by the first and second compressors. Such increased pressure may be utilized in embodiments wherein the pressure reducer comprises an expander.

According to embodiments, the third compressor may comprise a third turbocharger. In this manner, energy from the exhaust gas of the internal combustion gas engine may be utilized for increasing the pressure of the lean gaseous fuel mixture.

Further features of, and advantages with, the invention will become apparent when studying the appended claims and the following detailed description.

BRIEF DESCRIPTION OF THE DRAWINGS

Various aspects and/or embodiments of the invention, including its particular features and advantages, will be readily understood from the example embodiments discussed in the following detailed description and the accompanying drawings, in which.

DETAILED DESCRIPTION

Aspects and/or embodiments of the invention will now be described more fully. Like numbers refer to like elements throughout. Well known functions or constructions will not necessarily be described in detail for brevity and/or clarity.

Figure 1:
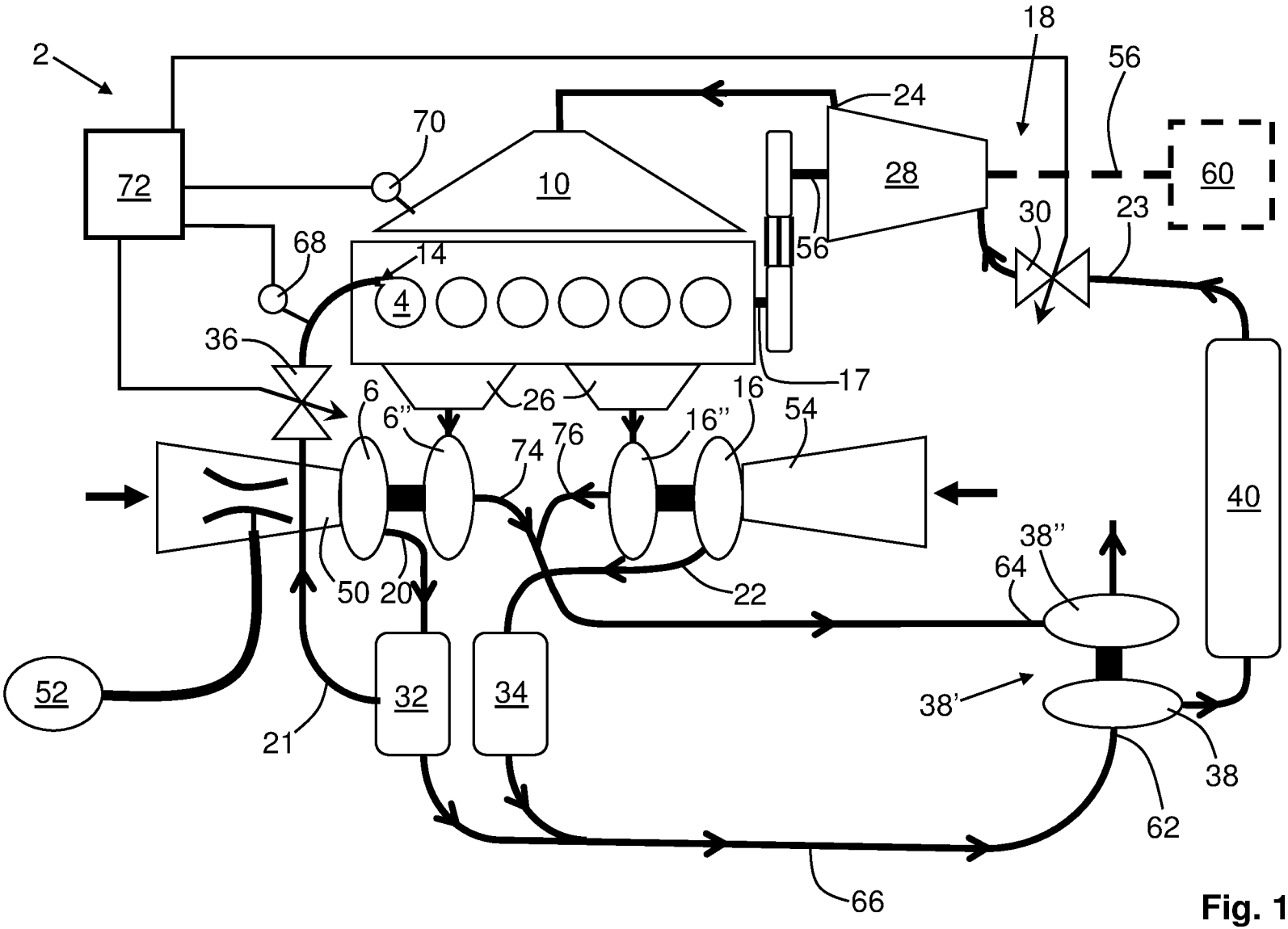
FIG. 1 schematically illustrates an internal combustion gas engine according to embodiments, FIG. 2 schematically illustrates a cross section through a cylinder arrangement of an internal combustion gas engine according to embodiments, FIG. 3 schematically illustrates a portion of an internal combustion gas engine according to embodiments, FIG. 4 schematically illustrates a generator set according to embodiments.

FIG. 1 schematically illustrates an internal combustion gas engine 2 according to embodiments. The internal combustion gas engine 2 may be either a four-stroke or a two-stroke internal combustion engine. The internal combustion gas engine 2 comprises at least one cylinder arrangement 4. In these embodiments the internal combustion gas engine 2 comprises six cylinder arrangements, i.e. in these example embodiments the internal combustion gas engine is a six cylinder engine. The internal combustion gas engine 2 further comprises a first compressor 6, a second compressor 16, and a pressure reducer 18. The cylinder arrangement 4 comprises a pre-chamber 14 arranged in connection with a combustion chamber and a sparkplug of the cylinder arrangement 4, as well as an intake arrangement 10, see further below with reference to FIG. 2.

The first compressor 6 is configured for compressing a gaseous fuel and air mixture. The second compressor 16 is configured for compressing a gaseous medium. An outlet 20 of the first compressor 6 is arranged in parallel with an outlet 22 of the second compressor 16. The outlets 20, 22 are outlets of the first and second compressors 6, 16 for pressurized gas for supply to the intake arrangement 10. The outlet 20 of the first compressor 6 and the outlet 22 of the second compressor 16 are connected to the pressure reducer 18.

Herein, the solitary term "gas" is used as a general term and relates to any gaseous component or mixture of gaseous components, which eventually is supplied to at least one of the combustion chamber and the pre-chamber 14. Accordingly, the term "gas" encompasses air, gaseous fuel, various mixtures of air and gaseous fuel. Herein, the term "charge gas" relates to the gaseous fuel mixture for charging the combustion chamber via the intake arrangement 10.

The outlets 20, 22 may be connected directly to the pressure reducer 18. However, in these embodiments the outlets 20, 22 are connected indirectly to the pressure reducer 18, via a number of further components, as will be discussed below.

An outlet 24 of the pressure reducer 18 is connected to the intake arrangement 10 for provision of pressure reduced charge gas to the cylinder arrangement 4.

The purpose of the pressure reducer 18 is to reduce the pressure in the charge gas reaching the intake arrangement 10. The pressure reducer 18 may comprise a passive component, such as a simple venturi tube or a valve 30, over which a pressure of the charge gas is reduced without utilizing the energy of the pressure reduction. Thus, according to embodiments, the pressure reducer 18 may comprise a pressure reduction valve 30. According to some embodiments, the pressure reducer 18 may comprise an expander 28. That is, in active component, over which the pressure of the charge gas is reduced while energy extracted during the pressure reduction may be utilized. In this manner, an output energy contribution may be provided by the expander 28, in addition to that of the internal combustion gas engine 2.

Mentioned purely as an example, the expander 28 e.g. may comprise a turbine expander, a scroll expander, a screw expander, or a similar device.

For instance, an output shaft 56 of the expander 28 may be connected directly or indirectly to a crankshaft 17 of the internal combustion gas engine 2. Thus, the energy from the pressure reduction in the expander 28 may be applied to the crankshaft 17 of the internal combustion gas engine 2 for being utilized as additional power available from the internal combustion gas engine 2.

According to alternative embodiments, as indicated with broken lines in FIG. 1, an output shaft 56 of the expander 28 may be connected to an electric generator 60. Thus, the energy from the pressure reduction in the expander 28 may be applied to the electric generator 60 for generating electrical energy.

According to some embodiments, the pressure reducer 18 may be configured for providing a variable pressure reduction. In this manner, a pressure at an outlet 24 of the pressure reducer 18 may be controlled, and thus, also the pressure in the intake arrangement 10 may be controlled. In particular, a pressure difference between the pre-chamber 14 and the combustion chamber determines the flow of gas into the pre-chamber 14.

Such a variable pressure reduction may be provided for instance with the pressure reducer 18 illustrated in FIG. 1 comprising an expander 28 and a controllable pressure reduction valve 30. Depending on the setting of the pressure reduction valve 30, the degree of pressure reduction in the expander 28 may be varied. According to alternative embodiments, the pressure reducer 18 may comprise a variable displacement expander.

According to some embodiments, such as in the illustrated embodiments, the outlet 20 of the first compressor 6 may be connected to the pressure reducer 18 via a first charge air cooler 32, and the outlet 22 of the second compressor 16 may be connected to the pressure reducer 18 via a second charge air cooler 34. In this manner, gas from the first and second compressors 6, 16 may be cooled in the first and second charge air coolers 32, 34. In the charge air coolers 32, 34 gas is cooled to improve their volumetric efficiency by increasing gas density through substantially isobaric cooling. Accordingly, also gaseous fuel, not only air, may be cooled in one, or both, of the first and second charge air coolers 32, 34. A charge air cooler may also be referred to as an intercooler. Charge air coolers as such are well known in the art.

According to embodiments, the outlet 20 of the first compressor 6 may be connected to the pre-chamber 14 via the first charge air cooler 32. In this manner, the density of the gaseous fuel and air mixture directed to the pre-chamber 14 may be increased. Moreover, cooling the gaseous fuel and air mixture after compression in the first compressor 6 prevents components coming in contact with the gaseous fuel and air mixture from being heated up. For instance, it may be advantageous to cool down the pre-chamber 14 as such.

A first conduit 21 for conducting gaseous fuel and air mixture to the pre-chamber 14 may be connected to a flow path for the gaseous fuel and air mixture within the first charge air cooler 32, as shown in FIG. 1. Thus, at least partially cooled gaseous fuel and air mixture may be conducted to the pre-chamber 14. Alternatively, the first conduit 21 for conducting gaseous fuel and air mixture to the pre-chamber 14 may be connected to the flow path for gaseous fuel and air mixture from the first charge air cooler 32 after the first charge air cooler 32, but before the flow path for gaseous fuel and air mixture from the first charge air cooler 32 connects to the flow path for gaseous medium from the second charge air cooler 34.

According to embodiments, wherein gaseous fuel and air mixture from the first compressor 6 does not require cooling, or wherein the gaseous fuel and air mixture may be sufficiently cooled in the first conduit 21, the first conduit 21 may connect to the flow path for gaseous fuel and air mixture from the first compressor 6 downstream of the outlet 20 of the first compressor 6 and upstream of the first air cooler 32.

According to embodiments, a control valve 36 may be arranged upstream of the pre-chamber 14. In this manner, the flow of gaseous fuel and air mixture to the pre-chamber 14 may be additionally controlled. As mentioned above, the pressure difference between the pre-chamber 14 and the combustion chamber of the cylinder arrangement 4 determines the flow of gaseous fuel and air mixture into the pre-chamber 14. The provision of a control valve 36 makes pressure control in the first conduit 21 possible. The control valve 36 may be provided in embodiments wherein the pressure reducer 18 is not variable. Alternatively, the control valve 36 may be provided also in embodiments wherein the pressure reducer 18 is variable in order to provide further control over the pressure difference.

According to some embodiments, e.g. as in the illustrated embodiments, the internal combustion gas engine 2 may comprise a third compressor 38. The third compressor 38 is arranged in series with the first and second compressors 6, 16 upstream of the pressure reducer 18. That is, the outlets 20, 22 of the first and second compressors 6, 16 are both connected to an inlet 62 of the third compressor 38. In this manner, a pressure of the charge gas may be further increased over that achieved by the first and second compressors 6, 16, before the charge gas reaches the pressure reducer 18. Such increased pressure may be utilized in embodiments wherein the pressure reducer 18 comprises an expander 28.

According to embodiments, a third charge air cooler 40 may be arranged downstream of the third compressor 38 and upstream of the pressure reducer 18. In this manner, the charge gas compressed in the third compressor 38 may be cooled before reaching the pressure reducer 18.

The third compressor 38 may comprise a third turbocharger 38'. A turbine expander 38" of the third turbocharger 38' may be driven by exhaust gas from the internal combustion gas engine 2.

In the six cylinder engine illustrated in FIG. 1 each of the six cylinder arrangements comprises a pre-chamber as discussed above. A separate conduit, or an at least partially common conduit, is connected to the outlet 20 of the first compressor 6 and leads to each pre-chamber of the cylinder arrangements. An inlet arrangement 10 is arranged for providing charge gas to the combustion chamber of each cylinder arrangement. Exhaust arrangements 26 of three cylinder arrangements are connected to the first turbocharger 6', and exhaust arrangements 26 of the three remaining cylinder arrangements are connected to the second turbocharger 16'. Alternatively, all six cylinder arrangements 26 may be connected to both of the first and second turbochargers 6', 16'.

Figure 2:
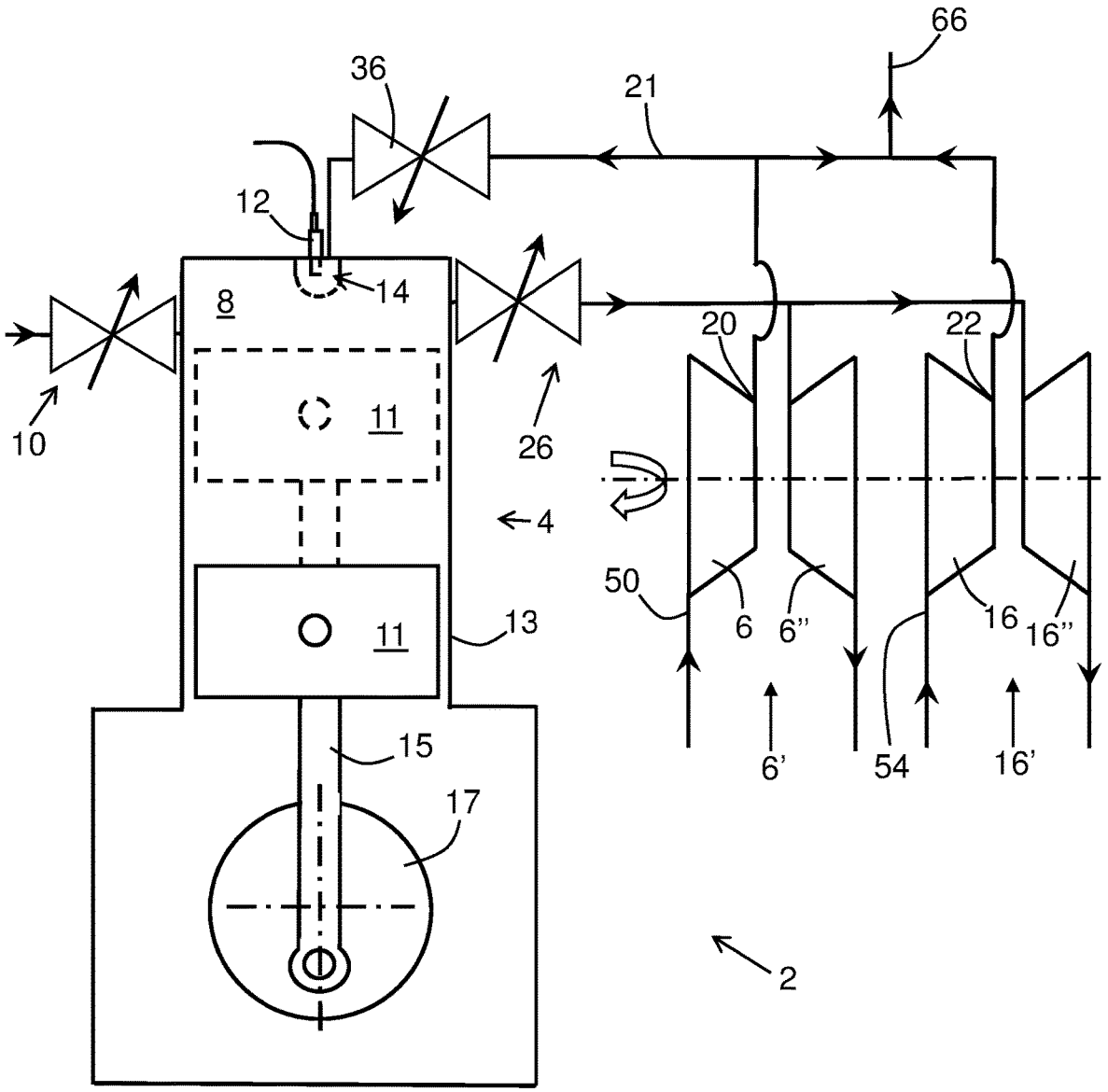

FIG. 2 schematically illustrates a cross section through a cylinder arrangement 4 of an internal combustion gas engine 2 according to embodiments. The internal combustion gas engine 2 is substantially similar to that of FIG. 1. The cylinder arrangement 4 forms a combustion chamber 8. In more detail, the combustion chamber 8 is formed above a piston 11 in a cylinder bore 13. The piston 11 is arranged to reciprocate in an ordinary manner in the cylinder bore 13. The piston 11 is illustrated with continuous lines at its bottom dead center, BDC, and with dashed lines at its top dead center, TDC. A connecting rod 15 connects the piston 11 with a crankshaft 17 of the internal combustion gas engine 2.

The cylinder arrangement 4 comprises an intake arrangement 10, a sparkplug 12, and a pre-chamber 14. The intake arrangement 10 is arranged for intake of charge gas into the combustion chamber 8. The intake arrangement 10 may comprise one or more conduits and one or more valves for conducting and controlling the flow of the charge gas into the combustion chamber 8. Such conduits and valves are well known and are only schematically indicated in FIG. 2. The pre-chamber 14 is arranged in connection with the combustion chamber 8 and the sparkplug 12. More specifically, the pre-chamber 14 forms a partially delimited volume, which communicates with the combustion chamber 8 via a plurality of apertures. A first conduit 21 for conducting a rich gaseous fuel mixture to the pre-chamber 14 is connected to the pre-chamber 14. The sparkplug 12 extends into the pre-chamber 14 such that a spark from the sparkplug 12 ignites at least a portion of the gaseous fuel and air mixture inside the pre-chamber 14 during operation of the internal combustion gas engine 2.

The cylinder arrangement 4 comprises an exhaust arrangement 26 for outflow of exhaust gas from the combustion chamber 8. The exhaust arrangement 26 may comprise one or more conduits and one or more valves for conducting and controlling the flow of the exhaust gas from the combustion chamber 8. Such conduits and valves are well known and are only schematically indicated in FIG. 2.

In these embodiments, the first compressor 6 comprises a first turbocharger 6 and the second compressor 16 comprise a second turbocharger 16'. The exhaust arrangement 26 is connected to the first and second turbochargers 6', 16' for driving the first and second turbochargers 6', 16'. More specifically, in a known manner turbine expanders 6", 16" of the respective first and second turbochargers 6', 16" are connected to the exhaust arrangement 26 for being driven by exhaust gas from the internal combustion gas engine 2. The turbine expanders 6", 16" drive the first and second compressors 6, 16. Thus, gas may be compressed in each of the first and second compressors 6, 16. The compositions of the gas in each of the compressors 6, 16 will be discussed below.

As mentioned above, the outlet 20 of the first compressor 6 is arranged in parallel with the outlet 22 of the second compressor 16. Further, the outlet 20 of the first compressor 6 is connected to the pre-chamber 14 via a first conduit 21.

Now, with reference to both FIGS. 1 and 2, gas flow in the internal combustion gas engine 2 during operation of the engine 2 will be discussed in more detail.

An inlet 50 of the first compressor 6 is supplied with air and gaseous fuel from a gaseous fuel source or storage 52, the two forming a gaseous fuel and air mixture. An inlet 54 of the second compressor 16 is supplied with air only, which forms a gaseous medium. According to alternative embodiments, the inlet 54 of the second compressor 16 may be supplied with a gaseous medium in the form of a leaner gaseous fuel and air mixture than the gaseous fuel and air mixture supplied to the inlet 50 of the first compressor 6.

Since the outlets 20, 22 of the first and second compressors both are connected to the pressure reducer 18 and are arranged in parallel, compressed gaseous fuel and air mixture from the first compressor 6 and compressed gaseous medium from the second compressor 16 are blended, at the latest as they reach an inlet 23 of the pressure reducer 18. In the illustrated embodiments of FIGS. 1 and 2, the compressed gaseous fuel and air mixture from the first compressor 6 and the compressed gaseous medium from the second compressor 16 are blended in a common second conduit 66 after the first and second charge air coolers 32, 34, and after the first and second compressors 6, 16, respectively.

Thus, a rich gaseous fuel mixture leaves the first compressor 6, and a lean gaseous fuel mixture is blended from the rich gaseous fuel mixture and the gaseous medium, before reaching the pressure reducer 18. A portion of the gaseous fuel and air mixture, i.e. the rich gaseous fuel mixture, compressed by the first compressor 6, is conducted to the pre-chamber 14 via the first conduit 21. The remaining portion of the rich gaseous fuel mixture is blended with the gaseous medium to form the lean gaseous fuel mixture. The lean gaseous fuel mixture forms the charge gas.

Air-fuel equivalence ratio, λ (lambda), is the ratio of the actual air-fuel ratio in relation to the air-fuel ratio at stoichiometry. $\lambda=1.0$ at stoichiometry, rich mixtures have $\lambda<1.0$, and lean mixtures have $\lambda>1.0$. At stoichiometry all fuel is combusted with the minimum amount of oxygen, i.e. after combustion only combustion gases remain, no unburnt fuel or oxygen remains. A very rich mixture, e.g. λ within a range of 0.4-0.8 is not possible or difficult to ignite with a sparkplug, a rich mixture having A within a range of 0.8-1.3 is ignitable with a sparkplug, and a lean mixture, e.g. having $\lambda\approx2$ also, is not possible or difficult to ignite with a sparkplug.

In order to achieve low $NO_X$ emissions with the exhaust gas from the internal combustion gas engine 2, the lean gaseous fuel mixture may have $\lambda=2$. Thus, the proportions of the rich gaseous fuel mixture and the gaseous medium, respectively, have to be blended accordingly. For this purpose the amounts of rich gaseous fuel mixture and gaseous medium may be set by a fixed volumetric relationship between the first and second compressors 6, 16. In such embodiments, the first and second turbochargers 6, 16 may share a common rotational axle. Alternatively, the rotational speeds of the first and second compressors 6, 16 may be controlled to provide a suitable relationship between the flow of rich gaseous fuel mixture and the flow of gaseous medium. In such embodiments, the first and second turbochargers 6, 16 require separate rotational axles. According to a further alternative, at least one of the first and second compressors 6, 16 may have a variable geometry. According to a further alternative one or more valves may be arranged to control the flow through at least one of the first and second compressors 6, 16. The relevant volumetric relationship, and relevant flows, respectively, are in turn determined by the gaseous fuel content of the rich gaseous fuel mixture and the gaseous medium.

According to some embodiments, the internal combustion gas engine 2 may be configured for avalanche activated combustion in the combustion chamber 8, wherein the gaseous fuel mixture admitted into the pre-chamber 14 has A within a range of 0.4-0.8. That is, the rich gaseous fuel mixture has within a range of 0.4-0.8.

Avalanche activated combustion, also referred to as LAG-process, has been discussed by Gussak et al. in SAE International paper No. 750890, published in 1975 under the title "High Chemical Activity of Incomplete Combustion Products and a Method of Pre-chamber Torch Ignition for Avalanche Activation of Combustion in Internal Combustion Engines". Briefly, a pressure difference between the pre-chamber 14 and the combustion chamber 8 dilutes a portion of the rich gaseous fuel mixture in the pre-chamber 14 with the lean gaseous fuel mixture in the combustion chamber 8, to a λ which is ignitable by the sparkplug 12. The ignited portion of the gaseous fuel mixture in the pre-chamber 14 heats up, and ejects remaining rich gaseous fuel mixture into the combustion chamber 8. A chemical/physical reaction causes the rich gaseous fuel mixture to ignite inside the combustion chamber 8 and thus, igniting the lean fuel mixture inside the combustion chamber 8.

Utilizing avalanche activated combustion reduces $NO_X$ content of the exhaust gas since substantially all combustible gaseous fuel is combusted at low temperature inside the combustion chamber 8.

According to alternative embodiments, the internal combustion gas engine 2 may be configured for in pre-chamber combustion, wherein the gaseous fuel mixture admitted into the pre-chamber 14 has A within a range 0.8-1.3. That is, the rich gaseous fuel mixture has within a range of 0.8-1.3.

In pre-chamber combustion entails that the rich gaseous fuel mixture is ignited by the sparkplug 12 and combusted mainly inside the pre-chamber 14. The combustion in the pre-chamber 14 initiates the combustion of the lean gaseous fuel mixture inside the combustion chamber 8. Low $NO_X$ content exhaust gas may thus be produced. Namely, the combustion of the rich gaseous fuel mixture inside the pre-chamber 14 is a high temperature combustion, which may produce $NO_X$. However, the $NO_X$ content of the total amount of exhaust gas from the cylinder arrangement 4 is low due to the relatively large amount of exhaust gas produced by low temperature combustion inside the combustion chamber 8.

As mentioned above, the lean gaseous fuel mixture is blended on its way towards the pressure reducer 18. In these embodiments, flow paths from the outlets 20, 22 of the first and second compressors 6, 16 connect downstream of the first and second charge air coolers 32, 34 at a junction into the second conduit 66. Keeping the flow paths from the first and second compressors 6, 16 separate a distance downstream of a connection point of the first conduit 21 to the flow path from the first compressor 6, may ensure that crossflow of the gaseous medium from the second compressor 16 into the first conduit 21 is prevented, which would otherwise dilute the rich gaseous fuel mixture.

The lean gaseous fuel mixture is further compressed in the third compressor 38, and cooled in the third charge air cooler 40 on its way to the pressure reducer 18.

According to alternative embodiments, the third compressor 38 and the third charge air cooler 40 may be omitted. Instead, the lean gaseous fuel mixture, via the second conduit 66, may be conducted directly to the pressure reducer 18.

In the pressure reducer 18 a pressure of the lean gaseous fuel mixture, i.e. the charge gas, is reduced.

The pre-chamber 14 needs to be fed with the rich gaseous fuel mixture at a higher pressure than a pressure of the lean gaseous fuel mixture charged into the combustion chamber 8. Namely, the pressure difference between the pre-chamber 14 and the combustion chamber 8 determines the flow of the rich gaseous fuel mixture into the pre-chamber 14. During charging of the combustion chamber 8, the high pressure in the pre-chamber 14 is required for filling the pre-chamber 14 with the rich gaseous fuel mixture in order to overcome the pressure of the charge gas in the combustion chamber 8. Mentioned as an example, the pressure difference may be approximately 1 bar. Accordingly, the pressure difference between the pre-chamber 14 and the combustion chamber 8 needs to be controlled during charging the combustion chamber 8 with charge gas. For instance, pressure transducers 68, 70 may be arranged in the first conduit 21 and the inlet arrangement 10 for indirectly determining the pressures in the pre-chamber 14 and the combustion chamber 8. The pressure transducers 68, 70 are electronically connected to a control unit 72 for determining the pressure difference. The control unit 72 is electronically connected to devices configured for controlling the pressure difference, such as e.g. the control valve 36 and/or the variable pressure reducer 18. Mentioned purely as an example, the pressure after the pressure reducer 18 and in the intake arrangement 10 may be 4 bar and the pressure in the first conduit 21 may be 3 bar.

The control unit 72 comprises a calculation unit which may take the form of substantially any suitable type of processor circuit or microcomputer, e.g. a circuit for digital signal processing (digital signal processor, DSP), a Central Processing Unit (CPU), a processing unit, a processing circuit, a processor, an Application Specific Integrated Circuit (ASIC), a microprocessor, or other processing logic that may interpret and execute instructions. The herein utilized expression calculation unit may represent a processing circuitry comprising a plurality of processing circuits, such as, e.g., any, some or all of the ones mentioned above. The control unit 72 may comprises a memory unit. The calculation unit is connected to the memory unit, which provides the calculation unit with, for example, the stored program code and/or stored data which the calculation unit needs to enable it to do calculations. The calculation unit may also be adapted to storing partial or final results of calculations in the memory unit. The memory unit may comprise a physical device utilized to store data or programs, i.e., sequences of instructions, on a temporary or permanent basis.

According to some embodiments, both the control valve 36 and the variable pressure reducer 18 are controlled to provide a desired pressure difference between the pre-chamber 14 and the combustion chamber 8. According to some embodiments, the control valve 36 is omitted, and the pressure difference is controlled via the variable pressure reducer 18 only.

After combustion, the exhaust gas leaves the cylinder arrangement 4 via the exhaust arrangement 26. In embodiments wherein any of the compressors 6, 16, 38 are turbochargers 6', 16', 38', the exhaust gas drives relevant turbine expanders 6", 16", 38". In FIG. 1 an example arrangement of the turbine expanders 6", 16", 38" is shown. The first and second turbine expanders 6", 16" are arranged in parallel and the third turbine expander 38" is arranged in series with the first and second turbine expanders 6", 16". The exhaust gas is supplied to an inlet 64 of the third turbine expander 38" from both outlets 74, 76 of the first and second turbine expanders 6", 16". Alternatively, the inlet 64 of the third turbine expander 38" may be supplied with exhaust gas directly from the exhaust arrangement 26 of the internal combustion gas engine 2, i.e. the turbine expander 38" may be supplied with exhaust gas in parallel with first and second turbine expanders 6", 16". According to a further alternative, the first, second and third turbine expanders 6", 16", 38" may be arranged in series.

Figure 3:
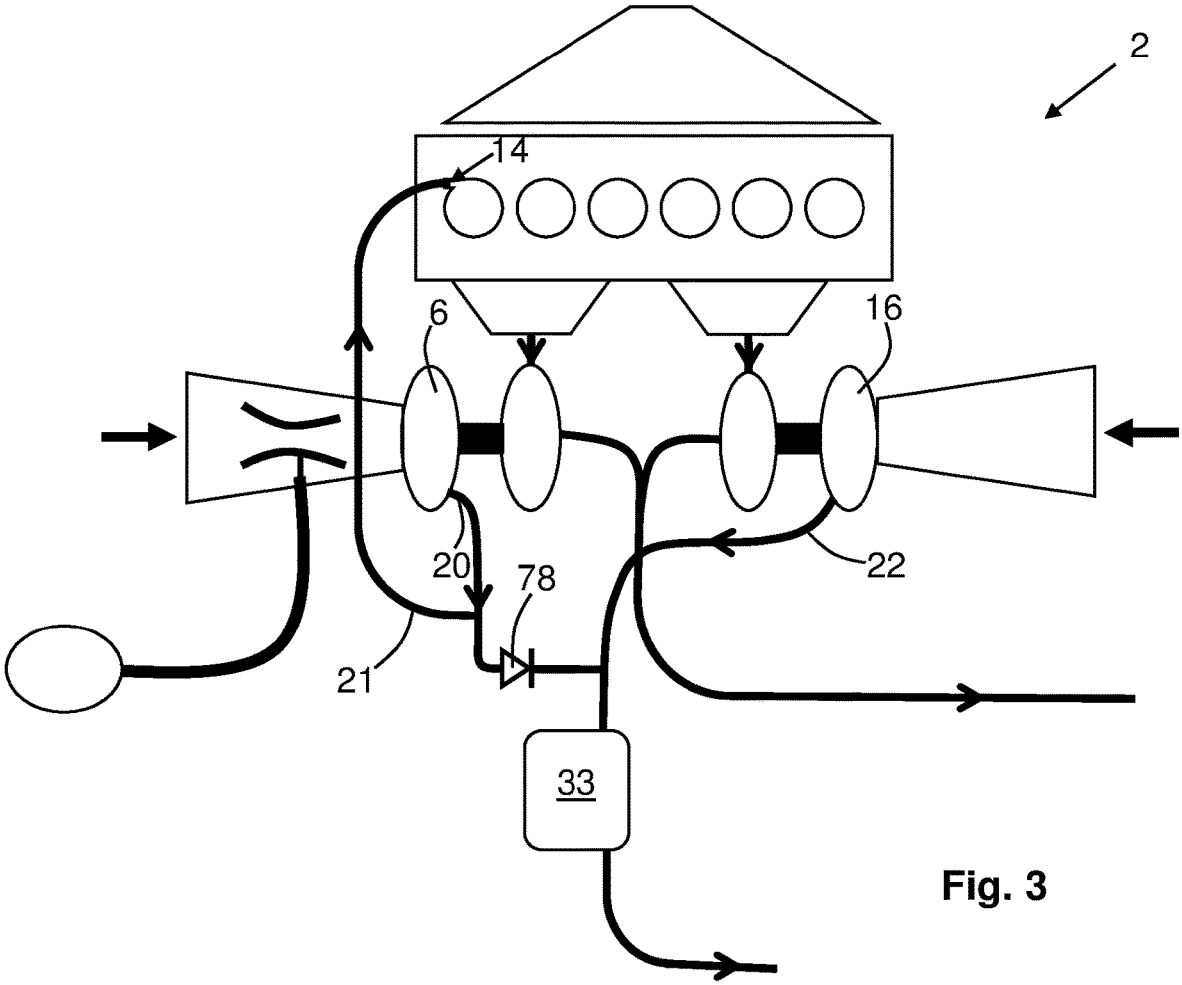

FIG. 3 schematically illustrates a portion of an internal combustion gas engine 2 according to embodiments. The internal combustion gas engine 2 resembles much of the internal combustion gas engine according to the previously discussed embodiments. In these embodiments, the outlet 20 of the first compressor 6 is connected to the pressure reducer 18 via a common charge air cooler 33, and the outlet 22 of the second compressor 16 is connected to the pressure reducer 18 via the common charge air cooler 33. In this manner, the lean gaseous fuel mixture is blended already before, or inside, the common charge air cooler 33. The first conduit 21 leading to the pre-chamber 14 is connected to the outlet 20 of the first compressor 6. A check valve 78 may be provided in order to prevent the gaseous medium from the second compressor 16 from flowing into the first conduit 21. In case the rich gaseous fuel mixture flowing towards the pre-chamber 14 should require cooling, a separate cooler may be provided in connection with the first conduit 21.

Figure 4:
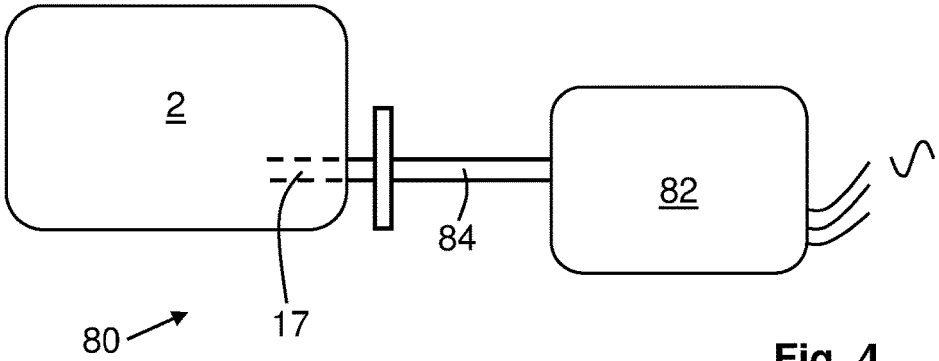

FIG. 4 schematically illustrates a generator set 80 according to embodiments. The generator set 80 comprises an internal combustion gas engine 2 and an electric generator 82. A crankshaft 17 of the internal combustion gas engine 2 is connected to a shaft 84 of the electric generator 82. The internal combustion gas engine 2 is an internal combustion gas engine 2 according to any one of aspects and/or embodiments discussed herein. The internal combustion gas engine 2 drives the generator 82 for producing electrical energy therein.

The internal combustion gas engine 2 discussed herein may be utilized in other applications than in a generator set. Suitably, the internal combustion gas engine 2 is used in applications, where a fairly constant rotational speed is required. Mentioned purely as an example, the internal combustion gas engine 2 may be utilized for driving a pump, or for driving a compressor.

Figure 5:
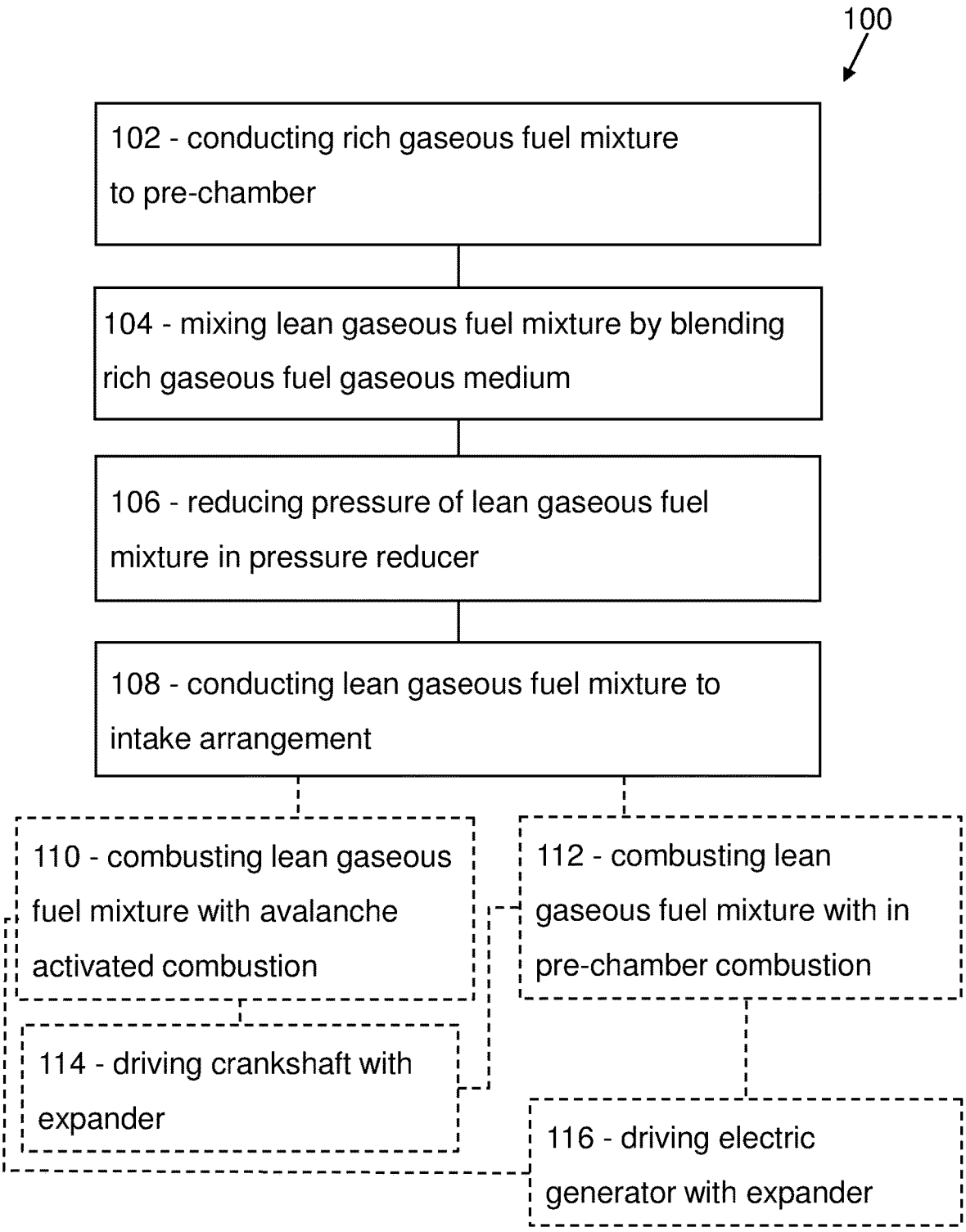
FIG. 5 illustrates a method for operating an internal combustion gas engine.

FIG. 5 illustrates a method 100 for operating an internal combustion gas engine. The internal combustion gas engine is an internal combustion gas engine according to any one of aspects and/or embodiments discussed herein. Accordingly, in the following reference is also made to FIGS. 1-3. The method 100 comprises steps of:

- conducting 102 a rich gaseous fuel mixture from an outlet 20 of the first compressor 6 to the pre-chamber 14,
- mixing 104 a lean gaseous fuel mixture by blending the rich gaseous fuel mixture from the outlet 20 of the first compressor 6 with the gaseous medium from an outlet 22 of the second compressor 16,
- reducing 106 a pressure of the lean gaseous fuel mixture in the pressure reducer 18, and
- conducting 108 the lean gaseous fuel mixture as a charge gas to the intake arrangement 10.

According to some embodiments, the rich gaseous fuel mixture has within a range of 0.4-0.8, the method 100 may comprise a step of:

- combusting 110 the lean gaseous fuel mixture in the combustion chamber 8 with avalanche activated combustion.

According to alternative embodiments, the rich gaseous fuel mixture has A within a range of range 0.8-1.3, the method 100 may comprise a step of:

- combusting 112 the lean gaseous fuel mixture in the combustion chamber 8 with in pre-chamber combustion.

According to embodiments wherein the pressure reducer 18 comprises an expander 28, and wherein an output shaft 56 of the expander 28 is connected to a crankshaft 17 of the internal combustion gas engine 2, the method 100 may comprise a step of:

- driving 114 the crankshaft 17 with the expander 28.

According to embodiments wherein the pressure reducer 18 comprises an expander 28, and wherein an output shaft 56 of the expander 28 is connected to an electric generator 60, the method 100 may comprise a step of:

- driving 116 the electric generator 60 with the expander 28.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the invention, as defined by the appended claims.

The invention claimed is:

1. An internal combustion gas engine comprising:

at least one gas engine cylinder arrangement and a first compressor configured for compressing a gaseous fuel and air mixture, wherein the at least one cylinder arrangement defines a combustion chamber and the combustion chamber comprises an intake arrangement for intake of charge gas into the combustion chamber, a sparkplug, and a pre-chamber which is arranged in connection with the combustion chamber and with the sparkplug;

the internal combustion gas engine further comprises a second compressor configured for compressing a gaseous medium, and a pressure reducer;

an outlet of the first compressor and an outlet of the second compressor are arranged in parallel;

the outlet from the first compressor is connected to the pre-chamber;

the outlet from the first compressor and the outlet from the second compressor are connected to the pressure reducer; and an outlet from the pressure reducer is connected to the intake arrangement.

2. The internal combustion gas engine according to claim 1, further comprising:

the at least one cylinder arrangement comprises an exhaust arrangement for outflow of exhaust gas from the combustion chamber;

the first compressor comprises a first turbocharger and the second compressor comprises a second turbocharger; and the exhaust arrangement is connected to the first and second turbochargers for driving the first and second turbochargers.

3. The internal combustion gas engine according to claim 1, wherein the pressure reducer is configured for providing a variable pressure reduction.

4. The internal combustion gas engine according to claim 1, wherein the pressure reducer comprises an expander.

5. The internal combustion gas engine according to claim 4, further comprising an output shaft of the expander and a crankshaft of the internal combustion gas engine which are connected.

6. The internal combustion gas engine according to claim 4, further comprising an output shaft of the expander and an electric generator which are connected.

7. The internal combustion gas engine according to claim 1, wherein the pressure reducer comprises a pressure reduction valve.

8. The internal combustion gas engine according to claim 1, further comprising a first charge air cooler connecting the outlet from the first compressor to the pressure reducer, and a second charge air cooler connecting the outlet from the second compressor to the pressure reducer.

9. The internal combustion gas engine according to claim 8, further comprising the first charge air cooler connecting the outlet from the first compressor to the pre-chamber.

10. The internal combustion gas engine according to claim 1, further comprising a common charge air cooler connecting the outlet from the first compressor to the pressure reducer, and connecting the outlet from the second compressor to the pressure reducer.

11. The internal combustion gas engine according to claim 1, further comprising a control valve arranged upstream of the pre-chamber for controlling entry of gas into the pre-chamber.

12. The internal combustion gas engine according to claim 1, further comprising a third compressor arranged in series with the first and second compressors (6, 16) upstream of the pressure reducer.

13. The internal combustion gas engine according to claim 12, wherein the third compressor comprises a third turbocharger.

14. The internal combustion gas engine according to claim 12, further comprising a third charge air cooler arranged downstream of the third compressor and upstream of the pressure reducer.

15. The internal combustion gas engine according to claim 1, further comprising, the engine being configured for avalanche activated combustion in the combustion chamber, wherein a gaseous fuel mixture admitted into the pre-chamber has $\lambda$ within a range of 0.4-0.8.

16. The internal combustion gas engine according to claim 1, the engine being configured for in pre-chamber combustion in the pre-chamber, wherein a gaseous fuel mixture admitted into the pre-chamber has $\lambda$ within a range 0.8-1.3.

17. A generator set comprising:

an internal combustion engine and an electric generator, a crankshaft of the internal combustion engine is connected to a shaft of the electric generator, and wherein the internal combustion engine is an internal combustion gas engine according to claim 1.

18. A method for operating an internal combustion gas engine, wherein, the internal combustion gas engine comprises at least one engine cylinder arrangement, a first compressor configured for compressing a gaseous fuel and air mixture, a second compressor configured for compressing a gaseous medium, and a pressure reducer;

wherein the at least one cylinder arrangement defines a combustion chamber comprising an intake arrangement for intake of charge gas into the combustion chamber, a sparkplug, and a pre-chamber arranged in connection with the combustion chamber and with the sparkplug, wherein the method comprises steps of:

conducting a rich gaseous fuel mixture from an outlet of the first compressor to the pre-chamber;

mixing a lean gaseous fuel mixture by blending the rich gaseous fuel mixture from an outlet of the first compressor with the gaseous medium from an outlet of the second compressor;

reducing a pressure of the lean gaseous fuel mixture in the pressure reducer; and conducting the lean gaseous fuel mixture as a charge gas to the intake arrangement.

19. The method according to claim 18, wherein the rich gaseous fuel mixture has $\lambda$ within a range of 0.4-0.8, and wherein the method comprises a step of:

combusting the lean gaseous fuel mixture in the combustion chamber with avalanche activated combustion.

20. The method according to claim 18, wherein the rich gaseous fuel mixture has $\lambda$ within a range of range 0.8-1.3 and wherein the method comprises a step of:

combusting the lean gaseous fuel mixture in the combustion chamber with in pre-chamber combustion.

* * * * *